US006365855B1

(12) United States Patent
Sutter et al.

(10) Patent No.: US 6,365,855 B1
(45) Date of Patent: Apr. 2, 2002

(54) ILLUMINATED BUTTON

(75) Inventors: Donald Edward Sutter, Martinsville; Mike William Toana, Speedway, both of IN (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/723,411

(22) Filed: Nov. 28, 2000

Related U.S. Application Data

(60) Provisional application No. 60/192,717, filed on Mar. 28, 2000.

(51) Int. Cl.[7] ..... H01H 9/00
(52) U.S. Cl. ..... 200/314; 200/345
(58) Field of Search ..... 200/5 A, 5 R, 200/517, 520, 310–314, 341, 345

(56) References Cited

U.S. PATENT DOCUMENTS

| | | | | |
|---|---|---|---|---|
| 3,267,926 A | | 8/1966 | Prince | 200/167 |
| 3,601,566 A | | 8/1971 | Hansen et al. | 200/167 A |
| 3,601,567 A | | 8/1971 | Shah | 200/167 A |
| 3,619,591 A | | 11/1971 | Korski | 240/2 |
| 4,016,388 A | | 4/1977 | Golbeck et al. | 200/314 |
| 4,017,700 A | | 4/1977 | West | 200/314 |
| 4,117,279 A | | 9/1978 | Schoemer | 200/5 A |
| 4,357,511 A | | 11/1982 | Tenner et al. | 200/314 |
| 4,370,532 A | | 1/1983 | Green | 200/314 |
| 4,683,359 A | | 7/1987 | Wojtanek | 200/314 |
| 5,081,329 A | | 1/1992 | Mitusinski et al. | 200/314 |
| 5,266,949 A | | 11/1993 | Rossi | 341/22 |
| 5,280,145 A | | 1/1994 | Mosier et al. | 200/313 |
| 5,399,820 A | | 3/1995 | Silfvast | 200/314 |
| 5,404,133 A | * | 4/1995 | Moriike et al. | 340/815.56 |
| 5,512,718 A | * | 4/1996 | Larose | 200/314 |
| 5,636,729 A | | 6/1997 | Wiciel | 200/181 |
| 5,697,493 A | | 12/1997 | Sach et al. | 200/314 |
| 5,698,825 A | | 12/1997 | Karasik | 200/5 A |
| 5,743,384 A | | 4/1998 | Clark | 200/344 |
| 5,865,302 A | * | 2/1999 | Suzuki et al. | 200/315 |
| 5,878,870 A | * | 3/1999 | Ohtaki | 200/314 |
| 5,901,836 A | * | 5/1999 | Taniuchi | 200/316 |

* cited by examiner

*Primary Examiner*—Michael Friedhofer
(74) *Attorney, Agent, or Firm*—J. S. Tripoli; F. A. Wein; R. D. Shedd

(57) ABSTRACT

An illuminated button for use with a shuttle knob mechanism. The mechanism includes an actuator disposed through a resilient member that is captured by a first retainer and supported by a second retainer and a light guide. The light guide is disposed through the light pipe and functions to illuminate on the face of the button.

15 Claims, 3 Drawing Sheets

ILLUMINATED BUTTON

This application claims the benefit of provisional application No. 60/192,717, filed Mar. 28, 2000.

BACKGROUND OF THE INVENTION

1. Field of the Invention

The present invention relates generally to mechanisms for activating electrical switches. More specifically, the present invention concerns a button assembly with an integrated light pipe for use with a shuttle knob mechanism.

2. Description of the Background Art

Assemblies for selectively actuating switch closures in response to a manual movement of a member, such as a button assembly, have seen increasing utility and are often found in devices such as computer interfaces, joysticks, automotive mirror controls and the like. Illuminated button assemblies, and applications in, for example, telecommunication devices, televisions and associated peripherals (i.e., control boxes, remotes, video players and the like). These illuminated button assemblies allow a user to select responses to menu prompts in a quick and efficient manner, using a minimal user interface. However, illuminated button assemblies require careful design and meticulous construction in order to enable the user of the illuminated button assembly to be able to view the button assembly. Often, misalignment between the button and the illumination source prevents the button assembly from becoming properly illuminated. Additionally, some illuminated button assemblies overheat due to the illumination source being integrated directly into the button assembly. This causes the illumination source to burn out prematurely and thus require replacement.

Other prior art switch activating mechanisms include captive, touch-type activators, optical interrupted beam type actuators and piezo-electric-type activators. As a general rule, these latter types of devices have limited applicability and are appropriate for only certain specialized applications.

Therefore, there is a need in the art for an illuminated button assembly providing good illumination characteristics and simplicity of assembly, in relation to other button assemblies. Furthermore, such illuminated button assemblies should be able to be used without thermal radiation to the tactile portion of the button assembly.

SUMMARY OF THE INVENTION

The disadvantages associated with the prior art are overcome by the present invention of a button spring assembly with an integrated light pipe. Specifically, the button with the integrated light pipe of the present invention comprises a light pipe having an alignment key, a switch activator and at least one graphic designator molded within the light pipe itself. The light pipe fits into a button spring support assembly which is comprised of a spring molded in between and to a bottom support ring and button cap on top. The light pipe slides in through the bottom support ring into the top button cap until it reaches an alignment key located on the cap. The alignment key of the light pipe helps to align the light pipe to its correct orientation with respect to the cap and the rest of the assembly. The top button cap is a circular cap on which is molded two alignment tabs for aligning the light pipe. The bottom support ring consists of a ring with an aperture and a set of alignment notches disposed about the outside perimeter of the support ring. At least one alignment pin is also disposed in the bottom face of the lower support ring. The alignment notches and alignment pin help to align the assembly when it is being installed on a PC board in a shuttle knob mechanism.

BRIEF DESCRIPTION OF THE DRAWINGS

The teachings of the present invention can readily be understood by considering the following detailed description in conjunction with the accompanying drawings, in which.

To facilitate understanding, identical reference numerals have been used, where possible, to designate identical elements that are common to the figures.

DETAILED DESCRIPTION

Figure 1B:
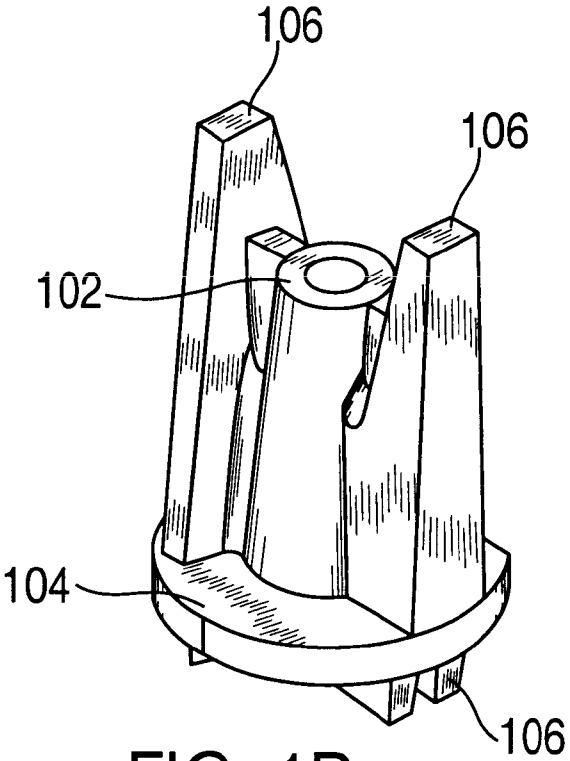
FIGS. 1A and 1B depict a perspective view of an embodiment of the light pipe of the present invention in different orientations showing the top and bottom of the light pipe.
Figure 1A:
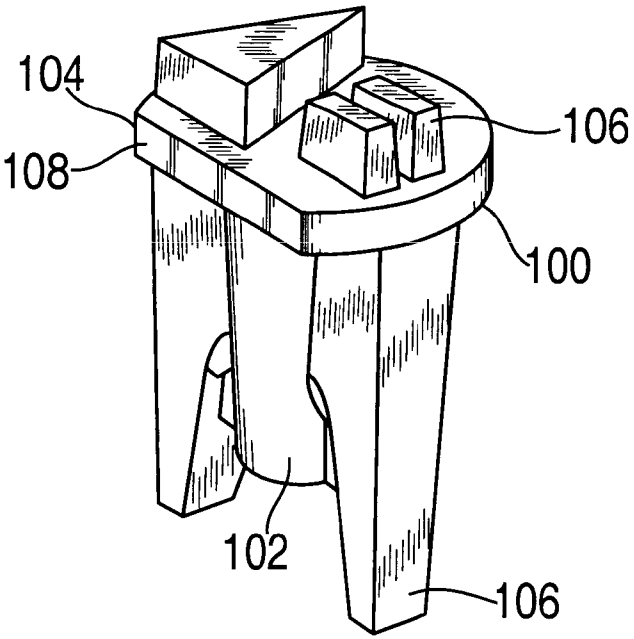

Specifically, FIG. 1 depicts a light pipe assembly 100 having an actuator 102 formed at the bottom of the light pipe assembly 100. The upper light pipe assembly 104 includes a set of graphic designators 106 which are disposed through the entire length of the light pipe assembly 100 down through the actuator portion 102 of the light pipe. The upper light pipe assembly also contains an alignment key 108 which is disposed around the outer perimeter of the upper portion 104 of the light pipe assembly 100. The light pipe assembly 100 is preferably fabricated from a moldable plastic, glass or any translucent/transparent material, or in the alternative, may simply be apertures projecting through the light pipe assembly 100 from the top portion through to the actuator portion 102.

Figure 2B:
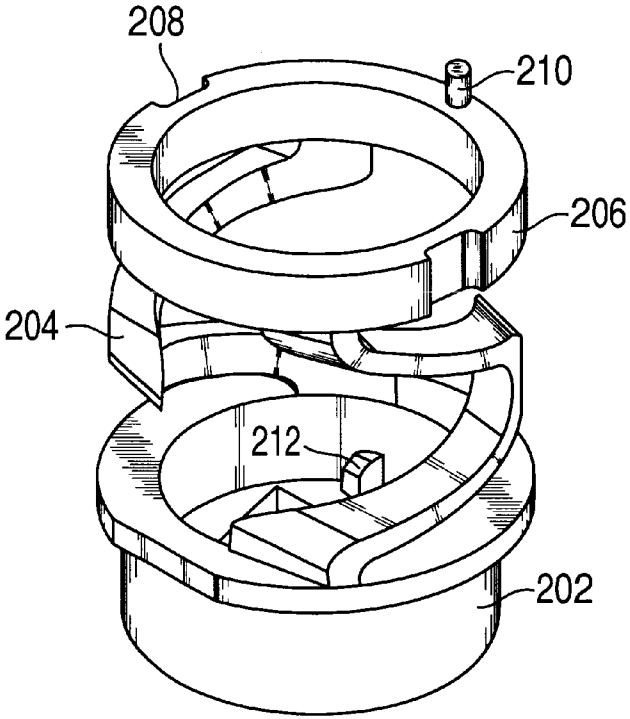
FIGS. 2A and 2B depict a perspective view of an embodiment of the button spring support assembly of the present invention in different orientations showing the support assembly from a top and bottom view.
Figure 2A:
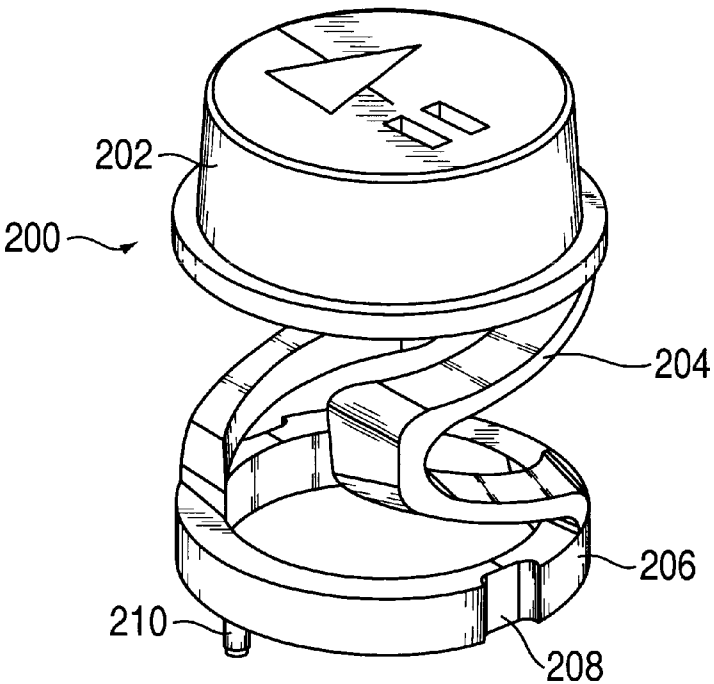

FIGS. 2A and 2B depict a button spring support structure 200 for use with the light pipe assembly 100. The button spring support assembly is comprised of an upper button cap 202 that contains a set of alignment tabs 212 disposed about the inside of the cap, as seen in FIG. 2B, a spring assembly 204 and a lower support ring 206. The cylindrical button spring 204 is molded between upper button support cap 202 and lower support ring 206 and is preferably fabricated from a moldable plastic, such as an elastomer. The fabrication material for the spring 204 is the same as the rest of the support unit 200 and is selected to preferably provide a resilient means to the spring 204. The lower support ring 206 is of a similar diameter to upper button cap 202 and supports upper button cap 202 and spring 204. Lower support ring 206 incorporates two alignment notches 208 and an alignment pin 210 to ensure proper placement of the entire assembly on a PC board. Specifically, the notches 208 align with tabs on the inside of the shuttle knob (not shown) while the pin 210 is inserted into an aperture formed in the P.C. board (not shown). Of course, the pin 210 and the notches 208 may be readily replaced by other types of locating structures commonly known in the art.

Figure 3:
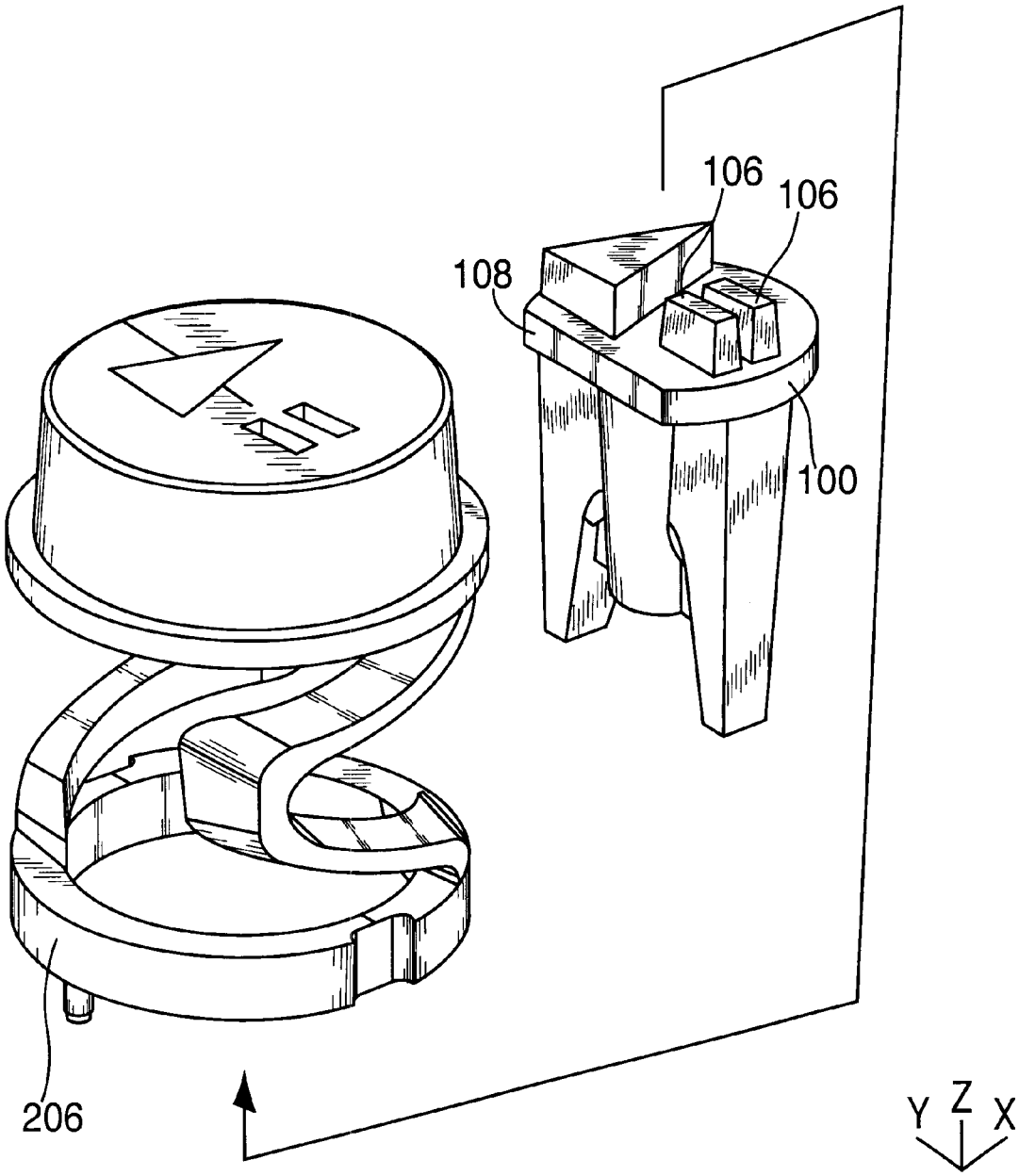
FIG. 3 depicts a perspective view of the method in which the light pipe is combined with the button spring support assembly of the present invention.

FIG. 3 depicts a perspective view of the light pipe assembly combined with the button spring support assembly of the present invention. As can be seen, the light pipe assembly 100 of FIG. 1 fits snuggly in the button spring support structure 200 of FIG. 2. In practice, the light pipe assembly 100 is aligned and inserted into the button spring support structure 200 by first placing the top light pipe portion 106 of the light pipe assembly 100 into the aperture of the lower support ring 206, the light pipe assembly 100 is then rotated so as to align alignment key 108 with corresponding alignment ribs 212 that are disposed in the upper button cap 202. Once aligned, the alignment key 108 slides adjacent to the alignment ribs 212 where the alignment ribs 212 prevent further rotation of the light pipe assembly 100. The light pipe is then sonically welded into the cap 202.

A completed assembly per FIG. 3 is ready to be installed between a printed circuit board assembly and a shuttle knob mechanism (not shown). The alignment notches are designed to fit into a shuttle knob mechanism or bezel assembly (not shown) and to prevent rotation of the bezel or shuttle knob about the light pipe assembly 100 and button spring support assembly 200.

As the embodiments that incorporate the teachings of the present invention have been shown and described in detail, those skilled in the art can readily devise many other varied embodiments that still incorporate these teachings without departing from the spirit of the invention.

What is claimed is:

1. Apparatus for actuating at least one switch comprising:

a first retainer;

a second retainer;

a resilient member disposed between said first and second retainers, and supporting said first retainer; and a light pipe including at least one graphic or designator and supported by said first retainer and protruding through said first retainer.

2. The apparatus of claim 1 wherein the first retainer comprises a button cap.

3. The apparatus of claim 2 wherein the button cap comprises at least one set of alignment tabs disposed about an inner circumference of said button cap.

4. The apparatus of claim 2 wherein the button cap comprises at least one alignment key.

5. The apparatus of claim 1 wherein the light pipe comprises at least one alignment key and a switch activator.

6. The apparatus of claim 5 wherein the at least one alignment key is formed on said light pipe to locate said light pipe in said button cap.

7. The apparatus of claim 5 wherein the at least one switch activator is formed on said light pipe.

8. Apparatus for activating at least one switch comprising:

a light pipe having at least one graphic designator, at least one alignment flat and at least one switch activator;

a retaining ring having an aperture, a thickness, an outside diameter and an inside diameter;

a button spring support ring assembly having an aperture, a thickness, an outside diameter, an inside diameter, and at least one set of alignment notches and at least one alignment pin; and a spring molded to and disposed between said retaining ring and said button spring support ring assembly.

9. The apparatus of claim 8 wherein said at least one graphic designator is disposed through said light pipe.

10. The apparatus of claim 9 wherein said at least one alignment flat is formed as an external feature on said light pipe.

11. The apparatus of claim 9 wherein said at least one switch activator is formed as an external feature on said light pipe.

12. The apparatus of claim 9 wherein a retaining ring aperture diameter is formed such that said aperture may accommodate said light pipe.

13. The apparatus of claim 9 wherein said spring is formed to and between said retaining ring and a button cap.

14. The apparatus of claim 9 wherein said alignment notches are disposed around a circumference of an outer diameter wall of said support ring assembly.

15. The apparatus of claim 9 wherein said at least one alignment pin is disposed on an outer circumference of said support ring assembly opposite of a side the spring is molded to.

* * * * *